United States Patent [19]

Lopez et al.

[11] 4,366,997

[45] Jan. 4, 1983

[54] HIDDEN DRAWER ARRANGEMENT FOR BANK TELLER CABINET

[75] Inventors: Bernard V. Lopez, Orinda; David T. Olsen, Petaluma, both of Calif.

[73] Assignee: BankAmerica Corporation, San Francisco, Calif.

[21] Appl. No.: 146,170

[22] Filed: May 2, 1980

[51] Int. Cl.[3] ..... A47B 17/04; E05C 5/00

[52] U.S. Cl. ..... 312/204; 312/320; 312/330 R; 292/7; 109/45

[58] Field of Search ..... 312/204, 320, 333, 330 R, 312/257 SK; 292/7, 40; 109/45

[56] References Cited

U.S. PATENT DOCUMENTS

| | | | |
|---|---|---|---|
| 915,999 | 3/1909 | Neal | 109/45 |
| 1,007,204 | 10/1911 | Honey | 292/7 |
| 1,368,052 | 2/1921 | Powell et al. | 312/257 SK |
| 2,449,433 | 9/1948 | Wheelock | 312/301 |
| 2,476,542 | 7/1949 | Gauss | 312/204 |
| 2,762,677 | 9/1956 | Reeves | 312/330 R |
| 2,775,501 | 12/1956 | Kyllo | 312/320 |
| 3,162,496 | 12/1964 | Morgan | 312/320 |
| 3,187,526 | 6/1965 | Moler | 292/7 |
| 3,207,565 | 9/1965 | Scharge | 312/320 |
| 3,268,282 | 8/1966 | Harvey | 312/204 |
| 3,298,765 | 1/1967 | Rakich | 109/45 |
| 3,375,051 | 3/1968 | Anderson | 312/330 R |
| 3,797,904 | 3/1974 | Krauth | 312/204 |
| 4,252,387 | 2/1981 | Wagner | 312/204 |

*Primary Examiner*—Victor N. Sakran

*Attorney, Agent, or Firm*—Flehr, Hohbach, Test, Albritton & Herbert

[57] ABSTRACT

A hidden drawer arrangement for a cash transaction cabinet. A drawer is mounted in slide-out fashion in a compartment of the cabinet. A plain face panel on the drawer extends the width of the compartment to have the appearance of an immobile structural element of the cabinet. A latch arrangement is provided on the bottom of the drawer and is hidden by a lower section of the drawer face panel extending below the plane of the drawer bottom.

7 Claims, 5 Drawing Figures

HIDDEN DRAWER ARRANGEMENT FOR BANK TELLER CABINET

This invention relates generally to cash transaction cabinets. More particularly, this invention relates to a hidden drawer arrangement for a bank teller cabinet or truck.

One of the strong concerns of modern banking institutions is to make it difficult for the lone, weapon-wielding robber to obtain a large amount of cash from the teller stations at the bank. Prior to the advent of modern banking practices, which typically involve the placement of numerous small branch banks at locations throughout metropolitan and suburban areas, the banking system largely comprised centrally located banks in which the security was provided by armed bank guards and teller station structures which physically isolated the bank tellers from the customers being served. To provide a more friendly atmosphere for regular bank customers, the modern approach to teller station design is to provide simply a partial wall and counter arrangement to separate the teller from the customer. Furthermore, in many of the small Branch banks, it is not economically feasible to provide a guard at each Branch bank location. Consequently, under these conditions, it is relatively easy for a lone, weapon-wielding robber to leap over the counter separating the tellers from the public and quickly grab supplies of cash from the cash drawers maintained at each teller station.

Another aspect of modern branch banking at metropolitan branches is the provision of a merchant teller station which is adapted to serve the cash demands of local merchants. The merchant teller station typically has a larger authorized cash supply than the other teller stations and this cash supply is typically stored in a merchant teller truck. The merchant teller truck essentially comprises a steel cabinet mounted on wheels so that the truck can be rolled between the vault and the merchant teller station. Merchant teller trucks generally have one or more lockable sliding drawers in the top portion of the cabinet for storing the working cash supply. Beneath the working case drawers is provided a compartment for storing other merchant transaction supplies such as rolls of coins. Generally, the merchant teller's supply of bills of various denominations is divided between a working supply in the upper cash drawers and a reserve supply generally stored in the lower compartment of the teller truck. In prior art merchant teller trucks, both the working cash in the drawers and the reserve cash in the lower compartment are readily accessible to the lone robber vaulting the counter. Consequently, the merchant teller truck is especially vulnerable to relatively large cash losses from these types of robberies.

Accordingly, it is the principal object of this invention to provide an improved cash transaction cabinet having a conveniently accessible hidden drawer arrangement in the cabinet for storage of reserve cash.

One aspect of this invention features a cabinet having a compartment and a hidden drawer arrangement in the compartment. The hidden drawer arrangement comprises means defining a pair of front facing wall sections on interior side walls of the compartment with the front facing wall sections extending a moderate distance into the interior of the compartment throughout at least substantially the entire height of the compartment to have the appearance of working structural elements of the cabinet. The hidden drawer arrangement further includes a drawer having a preselected height equal to less than one-fourth the height of the compartment and means for slidably suspending the drawer in a top portion of the compartment. The drawer includes a substantially plain front face panel having a width substantially equal to the width of the compartment such that edge portions of the face panel abut and overlap the facing wall sections when the drawer is closed to give the face panel the appearance of an immobile structural element of the cabinet. In a preferred embodiment the hidden drawer arrangement also includes a drawer latching means mounted on the underside of the bottom of the drawer with the face panel of the drawer having a bottom edge portion extending below the bottom of the drawer to hide the drawer latching means. Also in a preferred embodiment, the front facing wall sections are located a moderate distance from the front opening of the compartment and the drawer is designed with a depth less than that of the compartments such that, in the closed position of the drawer, the drawer face panel is at least partially hidden underneath the top wall of the compartment.

As applied to a cash transaction cabinet for a typical merchant teller truck, the invention features a cabinet comprising at least one lockable, sliding cash drawer arrangement provided in a top portion of the cabinet and adapted to store a working cash supply, a compartment provided in a lower portion of the cabinet for storing other transaction supplies, a hidden drawer arrangement provided in the compartment and adapted to store a supply of reserve cash and at least one lockable compartment access door including a side hinge arrangement for mounting the access door to the cabinet in a swing-out fashion. In this embodiment, the hidden drawer arrangement includes the following elements:

means defining a pair of front facing wall sections on interior side walls of the compartment, with the front facing wall sections extending a moderate distance into the interior of the compartment throughout at least substantially the entire height of the compartment to have the appearance of working structural elements of the cabinet;

a drawer having a preselected height equal to less than one-fourth the height of the compartment;

means for slidably suspending the drawer in a top portion of the compartment, and drawer latching means mounted on the underside of the bottom of the drawer. The drawer includes a plain front face panel having a preselected width and height with the width substantially equal to the width of the compartment such that the edge portions of the face panel abut and overlap the facing wall sections when the drawer is closed to give the face panel the appearance of an immobile structural element of the cabinet. The height of the face panel is selected such that the bottom portion thereof extends below the bottom of the drawer to hide the bottom-mounted latching means. The side hinge arrangement in the preferred embodiment includes a first hinge bracket attached to the cabinet, and a second hinge bracket attached to the access door, with the brackets together defining a hinge pin location outside the opening of the compartment and providing a ninety degree open position of the access door which provides clearance between the side edges of the hidden drawer face panel and the access door as the reserve cash drawer is opened.

From the above description of the general features of this invention, it should be apparent that a cash transaction cabinet embodying the principles of this invention has the advantage of providing a hidden drawer arrangement for storing a supply of reserve cash which is out of sight to a robber vaulting the bank counter but is conveniently accessible to bank personnel operating the merchant teller station. While the invention is principally directed to providing a hidden reserve cash drawer arrangement for a merchant teller truck, it should be apparent that the invention could advantageously be employed in stationary bank teller cabinets and cash transaction cabinets employed in retail stores and gas stations.

The above-stated objects, features, and advantages of this invention, together with other objects, features, and advantages thereof will be apparent from a consideration of the following detailed description of an exemplary embodiment as depicted in the accompanying drawings.

Figure 1:
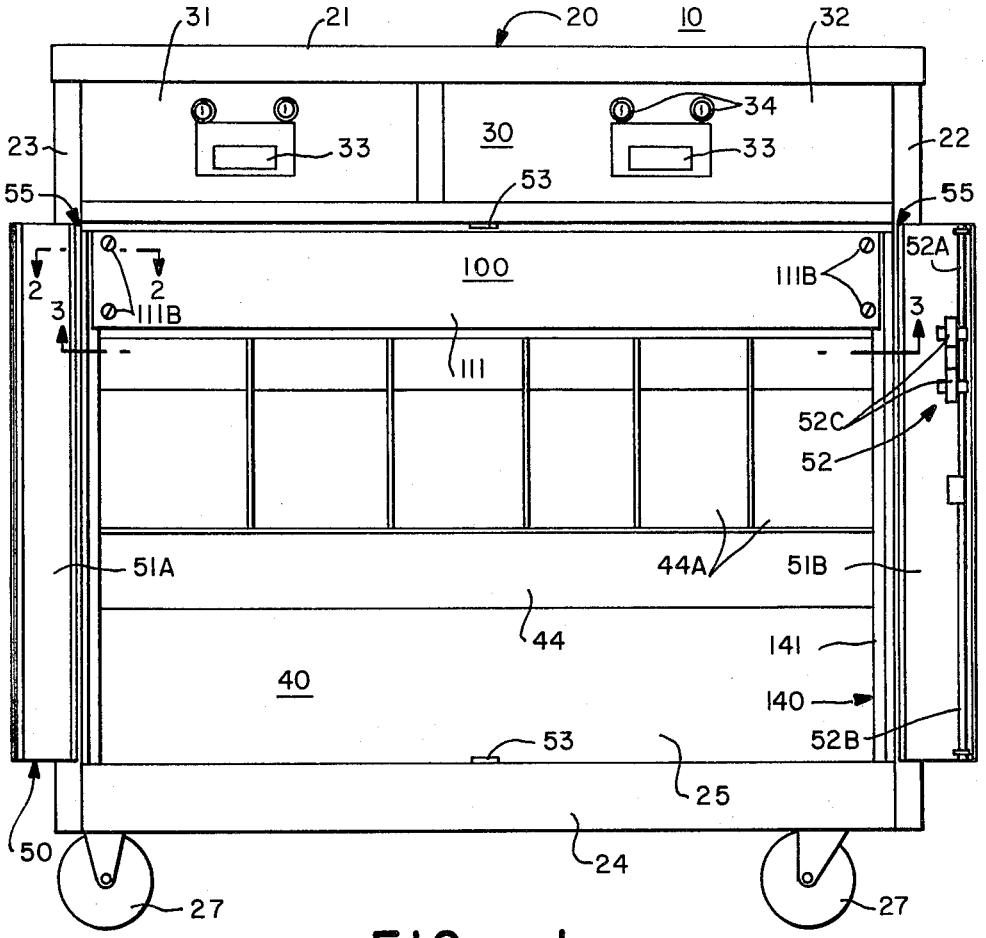
FIG. 1 is an elevational view of a merchant teller truck incorporating a hidden drawer arrangement in accordance with this invention.

FIG. 1 depicts the principal elements of a merchant teller truck 10 incorporating a hidden drawer arrangement 100 in accodance with this invention. Merchant teller truck 10 basically consists of a cabinet 20, a working cash drawer arrangement 30, a lower compartment 40, including an offset hinge arrangement 55. Hidden drawer arrangement 100 is mounted in lower compartment 40 with drawer face panel 111 extending substantially the width of the entire compartment and having a substantially plain appearance so that it looks like an immobile structural element of the cabinet. The details of this deceptive appearance of the hidden drawer face panel as it is integrated into the other structural features of the hidden drawer arrangement will be discussed later. If desired, false machine screw heads or bolt heads 111B may be provided on the edge portions of face panel 111 to make it appear that the face panel of the hidden drawer arrangement is actually fastened to other structure elements of the cabinet to further enhance the deceptive appearance of the hidden drawer arrangement.

The cabinet 20 of merchant teller truck 10 is a double wall type of cabinet having a top wall 21, a right side wall 22, a left side wall 23, and a bottom 24, and a back wall 25. A divider wall 26 separates cabinet 20 into an upper cabinet portion housing the working cash drawer arrangement 30 and a lower portion consisting of compartment 40. Cabinet 20 also has wheels 27 provided on the bottom 24 to enable it to be rolled between a merchant teller station at a customer counter and the vault at the bank location, where the merchant teller truck 10 is normally stored overnight.

The working cash drawer arrangement 30 in this embodiment includes a first working cash drawer 31 and a second working cash drawer 32. EAch of the working cash drawers 31, 32 includes a latch and handle arrangement 33 and a dual lock arrangement 34. Typically, the dual lock arrangement 34 involves separate keys for each lock, with one of the keys in the possession of the teller and the other key in the possession of an operations manager or other supervisory personnel at the bank location. In this fashion two individuals are required to open the working cash drawers. This provides additional security when the merchant teller truck is locked and the teller station is unoccupied.

The lower compartment 40 of the merchant teller truck includes an angular tray arrangement 44 which is supported on the inner walls of the right side 22 and left side 23 of the cabinet by way of a tray hanger 44B (FIG. 4) which mounts in an arrangement of slots 45A in a tray bracket 45 which, in turn, is fastened to the respective side walls of cabinet 20. This tray mounting arrangement is best seen in the partial views in FIGS. 4 and 5. Tray 44 includes a plurality of divided compartments 44A which are adapted to contain various transaction supplies, such as rolls of coins which are especially required for transactions with local merchants. In some instances, one or more of these compartments 44A of tray 44 will be provided with a very large stack of one dollar bills which act as "sucker cash", having the appearance of a large amount of money but actually having a relatively small total cash value compared to the reserve supply of larger denomination bills which would be carried in hidden drawer arrangement 100.

In the embodiment shown in FIG. 1, a locking door arrangement 50 is provided for compartment 40. Door arrangement 50 includes a pair of access doors 51A and 51B, a latch and dual lock arrangement 52 and a pair of offset hinge arrangements 55. The locking door arrangement 50 is in some respects a standard type of door arrangement for a merchant teller truck with the exception of the offset hinge arrangement 55 which, as will later be described in detail, enables the face panel 111 of hidden drawer arrangement 100 to clear the access doors 51A and 51B when those access doors are opened at a ninety degree angle to the front of cabinet 20. When access door 51A is in a closed position, respective top and bottom portions thereof rest against stop elements 53 located on the bottom 24 of the cabinet and the divider wall 26. When access door 51B is closed, it overlaps access door 51A. The latch and lock arrangement 52 includes a pair of latch throw arms 52A and 52B which may be extended into slots provided in cabinet bottom 24 and cabinet divider 26 to latch the drawer arrangement shut. The dual key locking arrangement 52C may then be utilized to lock up the latch arrangement, preventing withdrawal of the latch throw arms 52A and 52B. This is a standard latch and locking arrangement for this type of cabinet and many variations of latch and lock arrangement could be provided for the cabinet.

Figure 2:
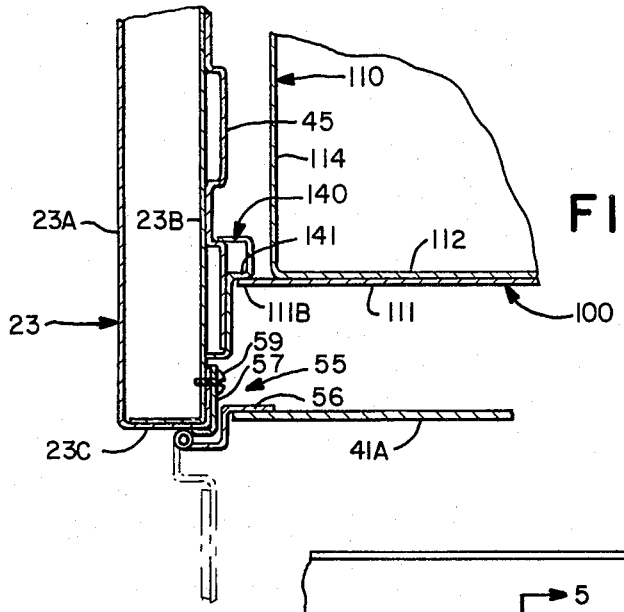
FIG. 2 is a partial section view of a hidden drawer arrangement in accordance with this invention taken along the lines 2—2 in FIG. 1.
Figure 4:
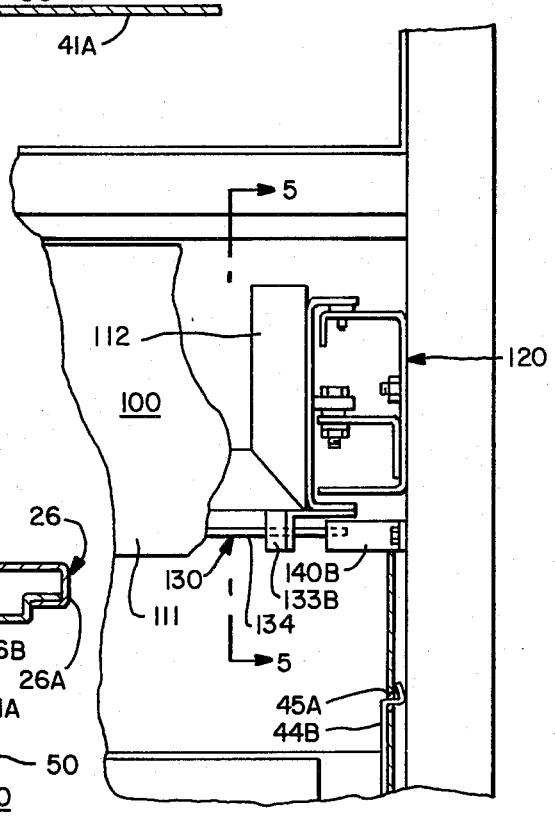
FIG. 4 is an enlarged, partly fragmented view of a portion of a hidden drawer arrangement in accordance with this invention.

FIG. 2 depicts a partial cross section of the structural arrangement of one side of the hidden drawer arrangement 100, together with an exemplary version of an offset hinge arrangement 55. As shown in FIG. 2, the left side 23 of cabinet 20 has a typical dual wall construction involving an exterior wall 23A, an interior wall 23B, and a front wall section 23C. The tray bracket 45 which is utilized to mount tray hanger 44B as depicted in FIG. 4, is fastened to the interior wall 23B by any convenient means such as spot welding. A preformed metal facing sheet 140 is fastened to tray bracket 45 by any convenient means such as spot welding. Facing sheet 140 defines a front facing wall section 141 which, as shown in FIG. 1, extends substantially the entire height of the compartment 40 to have the appearance of a working structural element of cabinet 20. While a separate facing sheet element 140 is depicted in FIG. 2, it should be apparent that any structural means could be utilized to define front facing wall section 141. For example, the interior wall 23B could be preformed to define the front facing wall section 141. Alternatively, the tray mounting bracket 45 could have its front section formed to be the means defining the facing wall section 141.

The front facing wall section 141 which extends a moderate distance into the interior of compartment 40 cooperates with the plain face panel 111 of hidden drawer arrangement 100 to give face panel 111 the appearance of an immobile structural element of the cabinet. As shown in FIG. 2, the width of drawer face panel 111 is preselected such that the edge portion 111B and a corresponding edge portion on the other side of the face panel (not shown) overlap facing wall section 141. Face panel 111 and facing sheet 140 are all painted the same color and tend to blend together to have the appearance of a structural feature of the cabinet. Since face panel 111 has a very plain face with no handle or pull arrangement on it, its appearance to the casual observer is one of a rigid structural feature rather than a movable drawer front. Accordingly, a robber having a strong motivation to quickly grab whatever bills are in plain sight in merchant teller truck 10 will not likely notice the existence of hidden drawer arrangement 100. It is believed that a robber will quickly grab up the cash contained in the working cash drawer arrangement 30 and whatever sucker cash or other small denomination bundles of bills are kept in the tray 44 of lower compartment 40 and leave untouched the large supply of reserve cash in hidden drawer arrangement 100.

FIG. 2 also depicts the important advantage achieved by using the offset hinge arrangement 55 to mount the access doors 41A (and 41B) to cabinet 20. Offset hinge arrangement 55 includes a first hinge bracket 57 which is attached to the interior wall 23B of left cabinet side 23 by any convenient fastening means such as machine screws 59. Hinge bracket 57 has a generally L-shaped cross section which fits around the interior corner of left-side wall 23 to define a location for hinge pin 58 which is offset from the interior wall 23B. The second hinge bracket 56 is fastened to an interior surface of access door 41A by any convenient means such as spot welding and has a generally S-shaped cross-sectional configuration to enable bracket 56 to position the access door 41A in an appropriate closed position to cover the compartment 40, but to provide for clearance between access door 41A and the face panel 111 of hidden drawer arrangement 100 when access door 41A is in a ninety degree position with respect to the face of cabinet 20 as shown in dotted lines in FIG. 2. It can thus be seen that this offset hinge arrangement 55 enables the hidden drawer to be pulled out without completely opening the access doors to the lower compartment. This is highly advantageous in that this enables the merchant teller truck to be positioned very close to a wall on either the right or left side of the merchant teller truck. When positioned adjacent a wall, the access doors of the merchant teller truck 10 can be opened to the ninety degree position depicted in FIG. 2 and the hidden drawer arrangement can be pulled out of the lower compartment 40 without having the edge 111B of the face panel 111 on the hidden drawer arrangement 100 striking the access door 41A (or 41B). While the offset hinge arrangement 55 is not essential to the hidden drawer arrangement of this invention, it is a preferred aspect thereof since it enables the merchant teller truck to be utilized conveniently in any location in a bank building.

Figure 3:
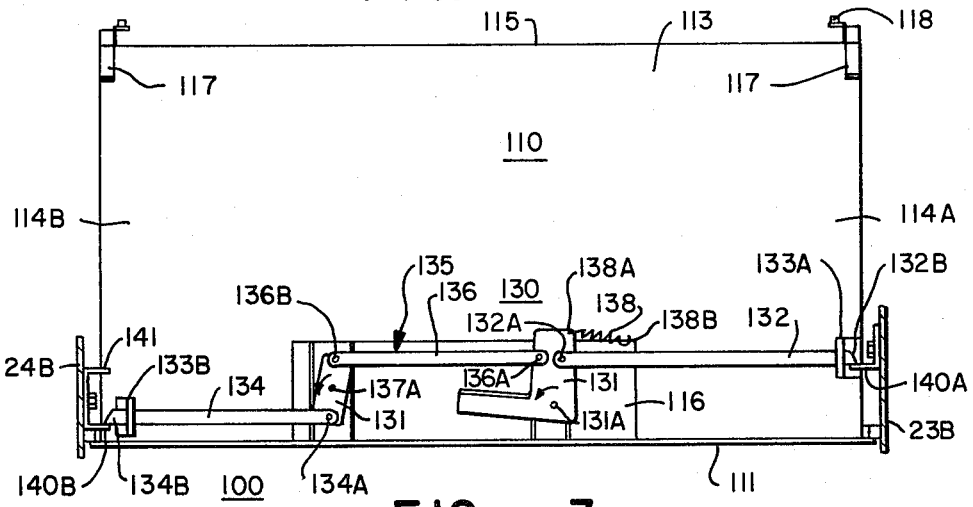
FIG. 3 is a bottom plan view of a hidden drawer arrangement in accordance with this invention taken from the direction 3—3 in FIG. 1 and showing an arrangement of a latching means.
Figure 5:
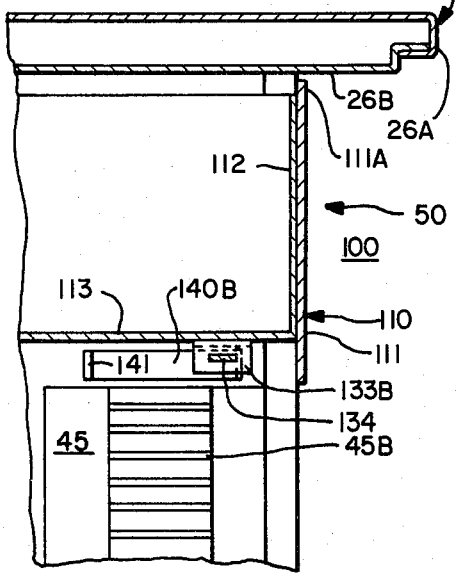
FIG. 5 is a partial section view taken along the lines FIG. 5—5 in FIG. 4.

Referring now to FIGS. 3, 4 and 5, the structural features of the hidden drawer arrangement 100 and a latching arrangement 130 therefore will be described. As depicted in FIG. 4, a drawer slide arrangement 120 is provided on each side of drawer 110 to enable drawer 110 to be easily slid between a closed position within compartment 40 and an open position wherein it is retracted from compartment 40 to give access to the open top of the drawer. As depicted in the various Figures, drawer 110 includes a face panel 111, mounted on a front drawer wall 112, a bottom 113, right and left sides 114A and 114B, and a back 115. Drawer 110 may be divided into compartments (not shown) for convenient organization of reserve cash into stacks of separate denominations.

FIG. 3 depicts the main elements of a drawer latch arrangement 130. Drawer latch arrangement 130 includes a latch actuator handle 131 which is pivotally mounted by a pivot arrangement 131A to the bottom 113 of drawer 110. Bottom 113 has a well 116 formed therein for housing certain portions of the latch mechanism. Latch handle 131 is spring loaded by way of a spring 138 which attaches at end 138A to latch handle 131 and at the other end 138B to the bottom 113 of drawer 110. A left latch bar 132 is pivotally mounted to latch handle 131 by a pivot mounting arrangement 132A. Left latch bar 132 extends through a slotted latch bar guide 133A and has an angled end wall 132B which cooperates with latch bracket 140A mounted on interior side wall 23B. Right latch bar 134 is pivotally mounted to a cam 137 by a pivot mounting arrangement 134A. Right latch bar 134 extends through a slot in latch bar guide 133B and has an end wall section 134B which cooperates with a latch bracket 140B mounted on interior side wall 24B. Cam 137 is pivotally mounted by a mounting arrangement 137A and is driven by a coupling arm 136 which is pivotally mounted both to cam 137 by a mounting arrangement 136B and to latch handle 131 by a pivot mounting arrangement 136A. The various pivot mounting arrangements may be of any convenient type.

FIG. 3 shows drawer 110 in a closed position with the left latch bar 132 engaged behind latch bracket 140A and the right latch bar 134 engaged behind latch bracket 140B. In this position, the drawer 110 is secured within compartment 40 (FIG. 1) in the positions depicted in FIGS. 1, 2, 4, and 5. If latch handle 131 is actuated by rotating it toward the drawer front, the left latch bar 132 and right latch bar 134 will disengage from respective latch brackets 140A and 140B and the drawer may be then slid out to an open position on the drawer slide arrangements 120 depicted in FIG. 4. To close drawer 110, the drawer need only be pushed back into the top of compartment 40. The angled end walls 132B and 134B of latch bars 132 and 134 will cause the respective latch bars to cam inwardly as they strike the latch brackets 140A and 140B. When the drawer 110 is in its fully closed position, the latch bars 132 and 134 will spring into a latched position behind the latch brackets 140A and 140B due to the action of tension spring 138.

FIG. 3 shows a pair of forward facing drawer stop brackets 117 mounted toward the rear of drawer bottom 113. These door stop brackets 117 cooperate with latch bracket 140A and a separate arm 141 on latch bracket 140B to determine a maximum open position of the drawer 110. In addition, on rear wall 115 of drawer 110, a pair of resilient stop arrangements 118 are provided to cushion the impact between the rear stop and the back wall 25 of cabinet 20 within compartment 40. These rear stop arrangements 118 also serve to urge drawer 110 toward a position where the latch bars 132 and 134 are tight against the latch brackets 140A and 140B. In this closed drawer position, the face panel 111 of drawer 110 has its edge portions 111B (both on the left side shown and the right side not shown) abutting and overlapping the facing wall section 141 as depicted in FIG. 2.

FIG. 4 illustrates that the latch arrangement 130 is hidden behind the face panel 111 of drawer 110 so that a straight-on view of hidden drawer arrangement 100 does not reveal the existence of the latch arrangement 130. As depicted in FIG. 5, the closed position of drawer 110 is such that the face panel 111 is spaced a moderate distance behind the front facing wall portion 26A of divider wall 26. Moreover, the top edge 111A of face panel 111 extends slightly above the top edge of drawer front 112, leaving only a small gap between the bottom surface 26B of divider 26 and the top edge 111A of face panel 111. This backwardly displaced location for the closed position of face panel 112 tends to hide the gap between the top edge 111A of face panel 111 and the bottom divider wall 26A.

While the hidden drawer arrangement of this invention has been described in connection with a preferred embodiment in the form of a merchant teller truck, it should be apparent that other types of embodiments of the invention could also be provided. For example, the hidden drawer arrangement of this invention could readily be implemented in a smaller stationary teller cabinet or any other type of stationary cash transaction cabinet. The preferred embodiment discussed above shows a compartment having a pair of hinged access doors, but it should be apparent that the hidden drawer arrangement could also be implemented in a narrower cabinet arrangement having only a single swing-out access door. Numerous hidden drawer latch arrangements could be utilized in addition to the one disclosed above. For example, magnetic latches or spring-detent latches could be employed at locations which are hidden from view. Numerous other modifications could also be made without departing from the principles of this invention as set forth in the following claims.

What is claimed is:

1. A hidden drawer arrangement for a compartment in a cabinet comprising means defining a pair of front facing wall sections on interior side walls of said compartment with said front facing wall sections being recessed a moderate distance into the interior of said compartment and extending throughout at least substantially the entire height of said compartment to have the appearance of working structual elements of said cabinet, a drawer having a preselected height equal to less than one-fourth the height of said compartment and a preselected depth less than the depth of said compartment, and means for slidably suspending said drawer in a top portion of said compartment, said drawer including a substantially plain, continuous, rectangular face panel having a width substantially equal to the width of said compartment such that edge portions of said face panel abut and overlap said front facing wall sections when said drawer is closed to give said face panel the appearance of an immobile structural element of said cabinet.

2. Apparatus as claimed in claim 1, wherein said face panel of said drawer has a bottom edge section extending a moderate distance below the floor of said drawer and further comprising drawer latching means mounted on the underside of said drawer in a hidden location.

3. In a cash transaction cabinet having at least one lockable, sliding cash drawer arrangement provided in a top portion of said cabinet and adapted to store a working cash supply, a compartment provided in the lower portion of said cabinet for storage of other transaction supplies, and at least one lockable compartment access door mounted to one side of said compartment with a hinge arrangement, a hidden drawer arrangement adapted to store a supply of reserve cash and comprising means defining a pair of front facing wall sections on interior side walls of said compartment with said front facing wall sections extending a moderate distance into the interior of said compartment throughout at least substantially the entire height of said compartment to have the appearance of working structural elements of said cabinet, a drawer having a preselected heighth equal to less than one-fourth the height of said compartment, and means for slidably suspending said drawer in a top portion of said cabinet, said drawer including a substantially plain face panel having a width substantially equal to the width of said compartment such that edge portions of said face panel abut and overlap said facing walls when said drawer is in a closed position to give said face panel the appearance of an immobile structural element of said cabinet.

4. Apparatus as claimed in claim 3, further comprising drawer latching means mounted in a hidden location on said drawer.

5. Apparatus as claimed in claim 4, wherein said front facing wall sections are located a moderate distance from the front of said cabinet and said drawer has a depth less than that of said compartment such that said drawer face panel is at least partially hidden underneath the top of said compartment when viewed from a standing position.

6. A cash transaction cabinet comprising at least one lockable, sliding cash drawer arrangement provided in a top portion of said cabinet and adapted to store a working cash supply, a compartment provided in a lower portion of said cabinet for storing other transaction supplies, a hidden drawer arrangement provided in said compartment and adapted to store a supply of reserve cash, and at least one lockable compartment access door including a side hinge arrangement for mounting said access door to said cabinet in a swing-out fashion, said hidden drawer arrangement including means defining a pair of front facing wall sections extending a moderate distance into the interior of said compartment throughout at least substantially the entire height of said compartment to have the appearance of working structural elements of said cabinet, a drawer having a preselected height of equal to less than one-fourth the height of said compartment, means for slidably suspending said drawer in a top portion of said cabinet, and drawer latching means mounted on the underside of the bottom of said drawer, said drawer including a plain front face panel having a preselected width and height, said preselected width being substantially equal to the width of said compartment such that edge portions of said face panel abut and overlap said facing wall sections when said drawer is in a closed position to give said face panel the appearance of an immobile structural element of said cabinet, and said preselected height of said face panel being greater than the height of said drawer such that a bottom edge portion thereof obscures said drawer latching means on the underside of said drawer; said side hinge arrangement including a first hinge bracket attached to said cabinet and a second hinge bracket attached to said access door, said brackets together defining a hinge pin location outside the opening of said compartment and providing a ninety degree open position of said access door which maintains clearance between side edges of said hidden drawer face panel and said access door as said reserve cash drawer is opened.

7. Apparatus as claimed in claim 4 or claim 6 wherein said face panel of said drawer has a bottom edge forming a flange which extends below the bottom wall of said drawer, and said latching means includes a pair of latch means securing said drawer to both sides of said cabinet, and a single latch release mechanism mounted to the underside of the bottom wall of said drawer behind said face panel flange and at a central location with respect to the sides of said drawer, said latch release mechanism being operable with one hand to unlatch both latch means to permit said drawer to be opened.

* * * * *